US005343913A

United States Patent [19]

Tanahashi et al.

[11] Patent Number: 5,343,913

[45] Date of Patent: Sep. 6, 1994

[54] WOOD TREATING METHOD AND APPARATUS

[75] Inventors: Mitsuhiko Tanahashi, 3-8, Daidokasiwadai 1-chome, Gifu-shi, Gifu 501-31; Masafumi Inoue, Nara; Syuzo Fukada, Kyoto; Chikayoshi Ota, Osaka; Senji Kimoto, Yamatokoriyama, all of Japan

[73] Assignees: Hisaka Works Limited, Osaka; Mitsuhiko Tanahashi, Gifu, both of Japan

[21] Appl. No.: 43,088

[22] Filed: May 21, 1993

Related U.S. Application Data

[63] Continuation of Ser. No. 741,417, Aug. 1, 1991, Pat. No. 5,247,975.

[30] Foreign Application Priority Data

| | | | |
|---|---|---|---|
| Dec. 25, 1989 | [JP] | Japan | 1-335595 |
| May 7, 1990 | [JP] | Japan | 2-117979 |
| Jun. 5, 1990 | [JP] | Japan | 2-147746 |
| Nov. 30, 1990 | [JP] | Japan | 2-337340 |

[51] Int. Cl.[5] ..... B27M 1/00; B27H 1/00

[52] U.S. Cl. ..... 144/380; 144/2 R; 144/271; 144/361

[58] Field of Search ..... 428/98, 106; 427/369, 427/370, 393, 440; 144/2 R, 271, 361, 359, 380

[56] References Cited

U.S. PATENT DOCUMENTS

| | | | |
|---|---|---|---|
| 1,403,722 | 1/1922 | Turnbull | 144/361 |
| 1,480,658 | 1/1924 | Bostock | 144/361 |
| 1,644,801 | 10/1927 | Der Werff | 144/361 |
| 2,567,292 | 9/1951 | Lundstrom | 144/380 |
| 2,586,308 | 2/1952 | Curtis | 144/380 |
| 2,793,859 | 5/1957 | Darling et al. | 144/380 |
| 2,973,793 | 3/1961 | Irvine | 144/271 |
| 4,017,980 | 4/1977 | Kleinguenther | 144/380 |
| 4,116,252 | 9/1978 | Ikeda | 144/380 |
| 4,469,156 | 9/1984 | Norimoto et al. | 144/380 |
| 4,605,467 | 8/1986 | Bottger | 144/271 |

FOREIGN PATENT DOCUMENTS 194320 6/1923 United Kingdom .

*Primary Examiner*—W. Donald Bray

*Attorney, Agent, or Firm*—Nikaido Marmelstein Murray & Oram

[57] ABSTRACT

A wood treating method and apparatus whereby a wood which is thin or bent, such as a soft wood or wood removed during growth or a wood from thinning, is strengthened, straightened and molded in any desired shape, wherein after the wood is heated and softened in a high temperature high pressure atmosphere, mechanical compressive forces are applied to the wood to minimize the voids in the wood; thus, the wood is hardened, strengthened and the bent wood is corrected, making it possible to form the wood in any desired shape without lumbering the same.

6 Claims, 9 Drawing Sheets

FIG.15
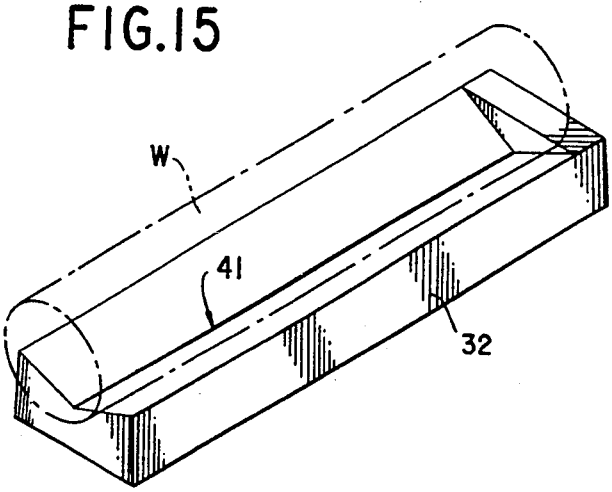
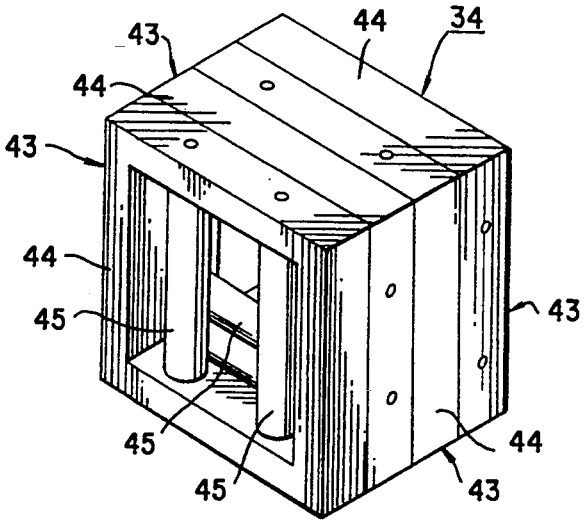
FIG.16
FIG.17
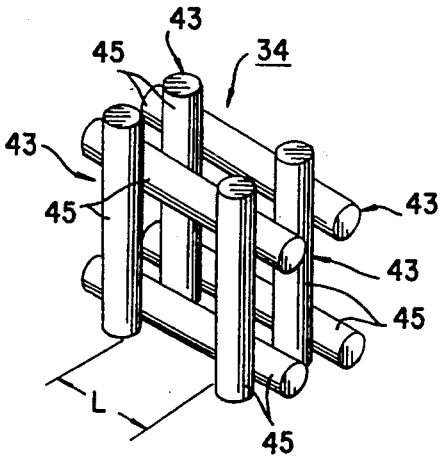

FIG.18
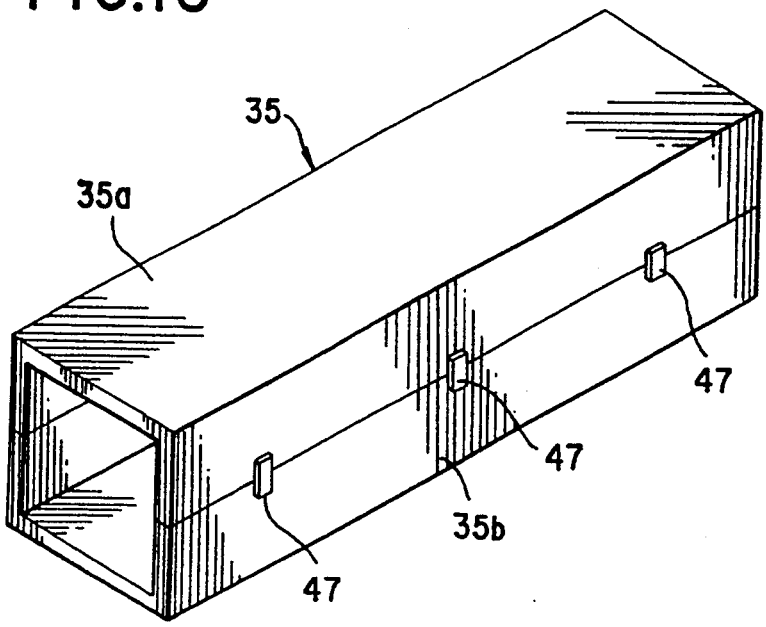
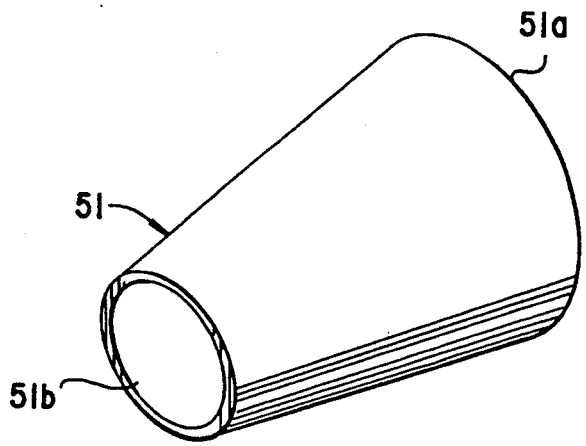
FIG.20
FIG.21
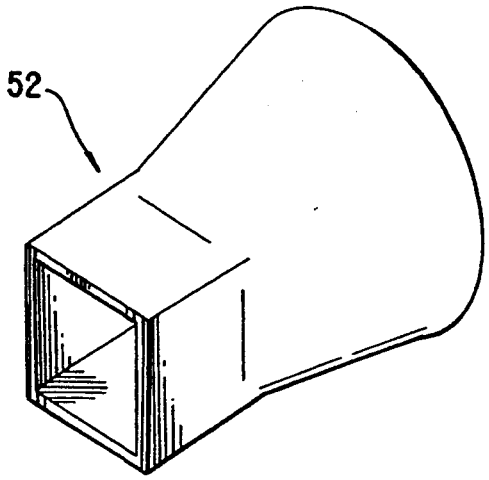

WOOD TREATING METHOD AND APPARATUS

This is a continuation, of application Ser. No. 07/741,417, filed Aug. 1, 1991 now U.S. Pat. No. 5,247,975.

BACKGROUND OF THE INVENTION

The present invention relates to a wood treating method and apparatus for treating woods which are slender or curved, for example, soft woods, such as Japanese cedars, Japanese larches, poplars and albizias, or woods from thinning, such as Japanese cedars and Japanese cypresses removed during growth, for strengthening, straightening and free-form shaping, to achieve high added values and effective utilization of woods.

Soft woods, such as Japanese cedars, though utilized as building materials, are limited in use because of their low strength. Further, woods left unused, such as Japanese larches, poplars and albizias, and woods from thinning, such as Japanese cedars and Japanese cypresses removed during growth, are small-diameter woods and, moreover, curved and excessively soft; thus, they are either left unused or discarded.

Accordingly, it has been usual practice to inject a resin, such as phenol resin, into woods, to strengthen the latter by the curing of the resin. However, since a large amount of resin has to be injected into wood, the resin cost is high and so is the treating cost. Further, a special injection device, a period of time (about one day) and substantial labor are required in order to inject resin uniformly into wood. At present, injection of resin into wood is very difficult. Further, since resin is injected into wood for strengthening purposes, the water absorption property which is characteristic of wood is lost, resulting in the wood assuming the plastic property, while losing its performance, functions and properties. Furthermore, if such treated wood is discarded as a waste material, a problem of pollution is raised by the resin during incineration (smoke from harmful materials, influences of high temperature on the incinerator, etc.).

Studies have been made for strengthening wood without using resin; for example, a study of compacting process based on heat treatment using microwaves has been made. However, no effective method has been found as yet for fixing a deformation produced by compaction. That is, absorbing an amount of water corresponding to compaction, the wood is restored to its original shape. Further, microwaves are limited in penetration depth, so that it is difficult to treat thick wood, and the cost is high.

SUMMARY OF THE INVENTION

The present invention is the result of an intensive study to solve the above-mentioned problems, finding that softening wood in a high temperature high pressure water vapor atmosphere and compression-molding and fixing it, is very effective means for strengthening wood.

Thus, an object of the invention is to provide a wood treating method and apparatus, based on softening wood in a high temperature high pressure water vapor atmosphere and compression-molding it to any desired shape and fixing it in this state, thereby strengthening wood and doing away with lumbering.

A wood treating method according to the present invention to achieve said object is characterized by softening wood in a high temperature high pressure water vapor atmosphere, compression-molding it, and fixing the resulting deformation by placing it in a high temperature high pressure water vapor atmosphere.

Placing wood in a high temperature high pressure water vapor atmosphere results in the wood absorbing the water vapor to increase its temperature (when wood is left to stand for several seconds to tens of minutes, the wood temperature rises to 130°–200° C.), whereby the wood is softened. In this state, mechanical compression forces are applied to the wood, thereby compressing the latter until it is reduced to about ½ to ⅓ in terms of cross-sectional area ratio while squeezing absorbed water, with the result that the voids formed in the wood are decreased in size and the wood is hardened and strengthened; thus, curved wood is straightened or wood can be freely treated without lumbering. As a result, the use of resin becomes unnecessary, reducing the treating cost to a great extent, enabling the strengthening process to be effected easily in a short time and efficiently, doing away with lumbering to obviate production of remnant wood material, and even if the wood is discarded as a waste material, there is no danger of pollution.

Simultaneously, the acetyl groups in hemicellulose contained in wood material are isolated and with the resulting acetic acid acting as a catalyst, the hemicellulose and lignin are partially depolymerized, resulting in the formation of such chemical substances as phenol compounds and furfural compounds which have the nature of impeding the growth of wood putrefying bacteria (basidiomycetes and the like). Thus, the antidecay property for combatting wood putrefying bacteria is improved.

Unlike heating with other heat sources (microwaves and the like) than water vapor, the wood, even if absorbing water or heated, will never be restored to its original shape.

Examples of the method will now be described.

A test piece cut from a Japanese cypress tree having a specific gravity of 0.3 was placed in a 15 kgf/cm$^2$ water vapor atmosphere for 15 minutes and then compressed to ⅓ of the original size. The specific gravity of this test piece became 0.9 and the color was a light brown. The test piece was pulverized and then added to culture soil lots for shiitake mushrooms, hiratake mushrooms (agarics) and kawaratake mushrooms, and in these culture soil lots, basidomycetes were cultured. It was found that the length of hyphae was ½ to 1/5 of that cultured in culture soil lots not having the test piece added thereto, demonstrating that the antidecay property was improved.

In the above example, treating was performed with cresol liquid added to the treating container so that its concentration was about 10%, and it was found that the test piece was impregnated with the cresol. Therefore, chemically protected wood can be obtained by mixing cresol or other chemical liquid with water vapor.

Further, a 22-years old Japanese cypress tree (10.05 cm diameter×7.5 cm length) from thinning was steamed in a 15 kgf/cm$^2$ water vapor atmosphere for 15 minutes and then it was compression-molded to a 7-cm square pillar form in said atmosphere by means of two opposed V-shaped jigs. In this manner, wood from thinning can be compression-molded into a pillar form without cutting it. The wood molded in the water vapor has its deformation fixed unlike the case of using microwaves, and the deformation will never be removed even when the wood later absorbs water.

The table shown below indicates that the wood molded by the above method will not be restored to its original shape when it absorbs water after it is compressed, the data being shown in comparison with the data on the wood in general use.

| | Japanese cedar, usual material | material compression-treated with microwaves, non-fixed | compressed material from thinning | remarks |
|---|---|---|---|---|
| specific gravity | 0.3 | 0.9 | 0.9 | |
| hardness | 0.6 | 3.0 | 3.0 | (1) |
| Young's modulus for bending | $80 \times 10^3$ | $160 \times 10^3$ | $160 \times 10^3$ | (2) |
| compression strength | 450 | 800–900 | 800 | (3) |
| water absorption percentage | 200–300% | 200–300% | 240–300% | (4) |
| size change upon water absorption | 1.15 times | 2.9 times | 1.05 times | (5) |

(The compressed material: obtained by compressing wood from thinning to $\frac{1}{3}$)

In the above table, (1) means kgf/cm$^2$, (2) means kgf/cm$^2$, (3) means kgf/cm$^2$, in the fiber direction, (4) means that the original weight is taken as 100, the water content being 15%, and (5) means that the direction is at right angle with the fibers.

It is seen from the above table that the wood compressed by the present inventive method will not be restored to its original shape even if it absorbs water after compression. It seems that the reason is that the wood undergoes a chemical change owing to the water vapor pressure.

In addition, if the water vapor pressure is less than 5 kgf/cm$^2$, such chemical change will not take place, while if it is greater than 25 kgf/cm$^2$, the decomposition of wood components proceeds, degrading the physical properties of wood.

Embodiments of the invention will now be described with reference to the accompanying drawings.

BRIEF DESCRIPTION OF THE DRAWINGS

FIG. 15 is a detailed perspective view of a support block in the second embodiment;

FIG. 16 is a detailed perspective view of a roller die in the second embodiment;

FIG. 17 is a perspective view thereof with its frame removed;

FIG. 18 is a detailed perspective view of a fixed case in the second embodiment;

FIGS. 20 and 21 are perspective views showing modifications of the die.

DESCRIPTION OF THE PREFERRED EMBODIMENTS

Figure 1:
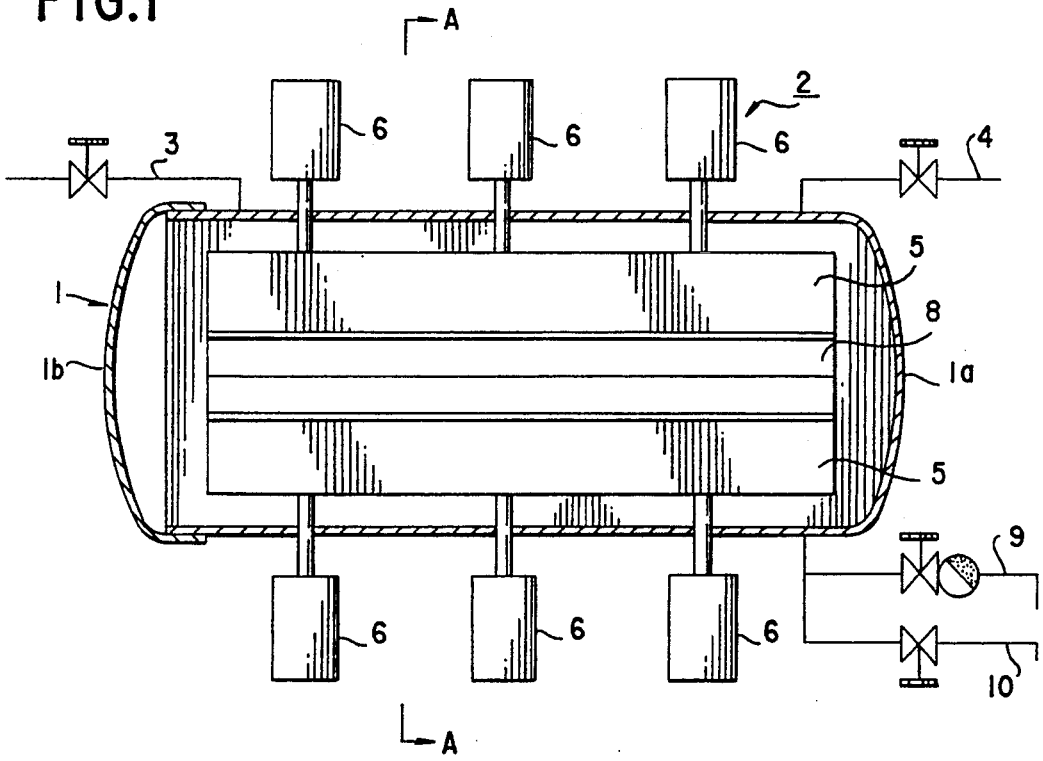
FIG. 1 is a schematic view, in longitudinal section, showing a first embodiment of the apparatus for embodying the wood treating method according to the invention.

FIG. 1 shows a first embodiment of an apparatus for carrying out the wood treating method according to the invention. The numeral 1 denotes a treating container and 2 denotes a press machine.

The treating container 1 comprises a cylindrical container body 1*a* made of high strength steel, and a door 1*b* attached to the opening in said body so that it can be opened and closed. High temperature (100°–230° C.) high pressure (5–25 kgf/cm$^2$) water vapor is fed to the container body through a pipeline 4, while a gas having a chemical liquid, such as creosote (a wood preservative), mixed therewith according to the necessity and purpose is injected into the container body through a pipeline 3.

The press machine 2 comprises a pair of press molds 5 each bent at right angle in V-shape and disposed inside said treating container 1 in vertically opposed relation, a plurality of press cylinders 6 for raising and lowering said press molds, and a pair of opposed press auxiliary jigs 8 each bent at right angle in V-shape and slidably mounted between the opposed end edges of said press molds 5 to cooperate with the press molds to define an expandable space 7. Thus, the wood W in said space is compression-molded by the press molds 5 and press auxiliary jigs 8 as the press molds 5 are moved toward each other by the press cylinders 6.

In addition, the numeral 9 denotes a pipeline for discharging the water vapor drain from the treating container 1, and 10 denotes a pipeline for opening the treating container to the open air for exhaust.

The operation for treating wood by the present inventive apparatus arranged in the manner described above will now be described.

Figure 2:
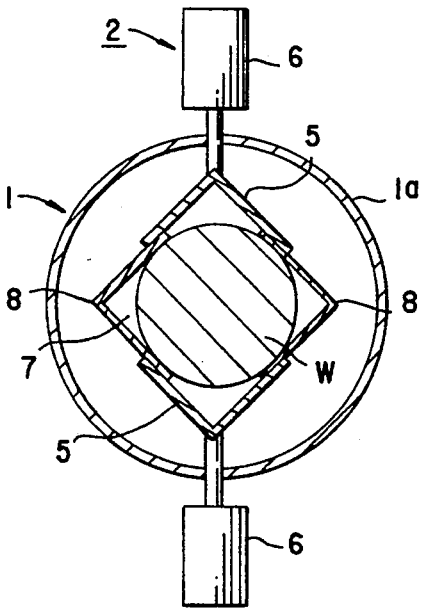
FIGS. 2 and 3 are sectional views taken along the line A—A in FIG. 1, FIG. 2 showing the state existing before compression and FIG. 3 showing the state existing during compression.

First, a wood W to be treated is introduced into the container body 1*a* of the treating container 1 and is mounted on the lower press molds 5 within the space 7 defined by the press molds 5 and press auxiliary jigs 8 of the press machine 2 or, as shown in FIG. 2, it is gently clamped by the press molds 5 through the press auxiliary jigs 8.

Figure 3:
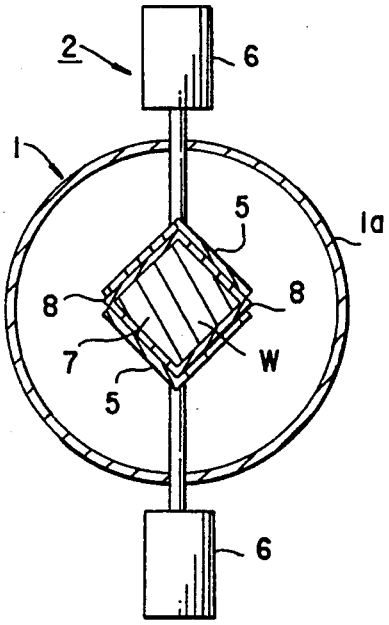

Then, the door 1*b* is attached to the opening in the container body 1*a* of the treating container 1 to close the treating container 1, whereupon high temperature (100°–230° C.) high pressure (5–25 kgf/cm$^2$) water vapor is fed to the container body through a pipeline 4, while a gas having a chemical liquid, such as creosote, mixed therewith according to the necessity and purpose is injected into the container body through a pipeline 3. In this state, the wood W is left to stand for a predetermined time (several seconds to tens of minutes) to soften the same, whereupon the press molds 5 of the press machine 2 are moved toward each other by the press cylinders 6 and the wood W held in the space 7 of the treating container is compressed by the press molds 5 through the press auxiliary jigs 8 until it is reduced to $\frac{1}{2}$–$\frac{1}{3}$ in terms of cross-sectional area ratio, shown in FIG. 3. In this state, the wood W is left to stand for a predetermined time (several ten seconds to tens minutes to fix the wood W.

With the wood W thus fixed, as soon as the injection of the water vapor and chemical-mixed gas into the treating container 1 is stopped, the water vapor drain in the treating container 1 is discharged through the pipeline 9 while the treating container 1 is gradually exhausted into the open air through the pipeline 109. Thereafter, the door 1*b* is removed from the opening in the container body 1*a* of the treating container 1 to open the treating container 1 and the press molds 5 of the press machine 2 are moved away from each other by the press cylinders 6, whereupon the compression-molded wood W is removed from the treating container 1 to complete the treatment.

Figure 4:
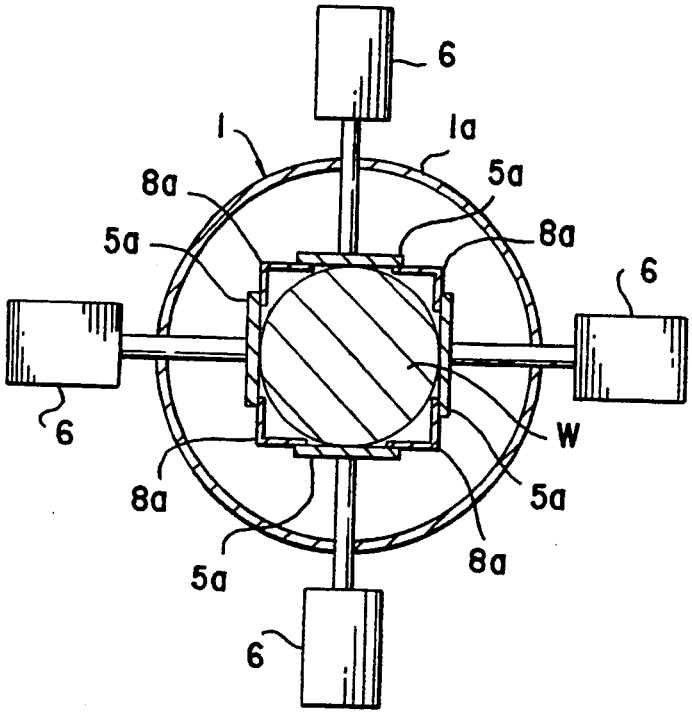
FIGS. 4 and 5 are sectional views showing a modification of a press machine.
Figure 5:
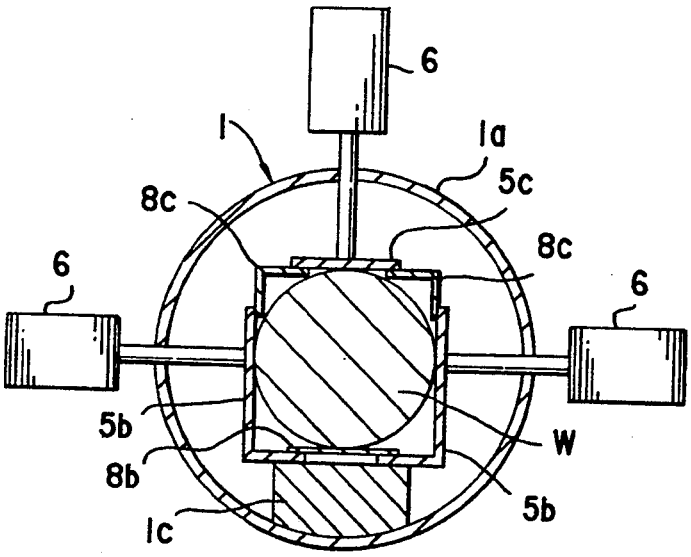

In the above embodiment, compressive forces are applied to the wood W in two directions, upward and downward, to compression-mold the wood W; however, as shown in FIG. 4, flat press plates 5*a* may be disposed at upper and lower and right and left positions in the treating container 1 in opposed relation so that they are vertically and horizontally moved toward or away from each other by press cylinders 6, with press auxiliary jigs 8*a*, which are bent at right angle in L-shape, interposed between the adjacent press plates 5*a* for slide movement with respect to said press mold 5*a*. Thus, compressive forces are applied to the wood W in four directions, upward, downward, rightward and leftward, so as to compression-mold the wood W. Further, as shown in FIG. 5, press plates 5*b* bent at right angle in L-shape adapted to be driven toward or away from each other by press cylinders 6 may be disposed on a fixed block 1*c* in the treating container 1, while a flat press plate 5*c* adapted to be driven upward and downward by a press cylinder 6 is disposed above and intermediate between the press plates 5*b*. And a flat press auxiliary jig 8*b* and L-shaped press auxillary jigs 8*c* bent at right angle are disposed between the horizontal portions of the press plates 5*b* and between the vertical portions of the press plates 5*b* and the press plate 5*c* so that they are slidable with respect to the press plates 5*b* and 5*c*; thus, compressive forces are applied to the wood W in three directions, upward, rightward and leftward, to compression-mod the same.

The opposed press molds 5 and press plates 5*a* and 5*b* have been arranged to be driven toward and away from each other by the press cylinders 6. However, one of the two may be fixed, the other alone being driven so as to compression-mold the wood W.

Figure 6:
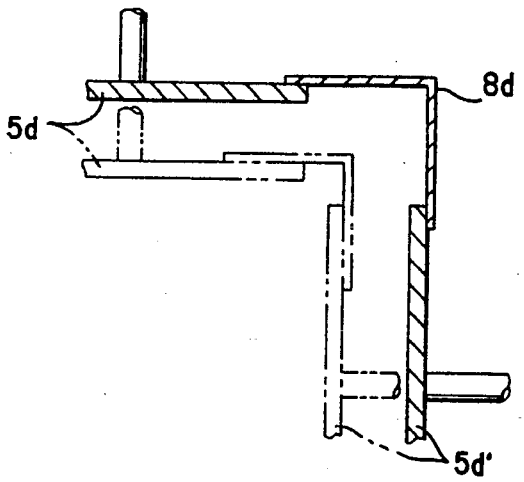
FIGS. 6 and 7 are enlarged views showing a press auxiliary jig.
Figure 7:
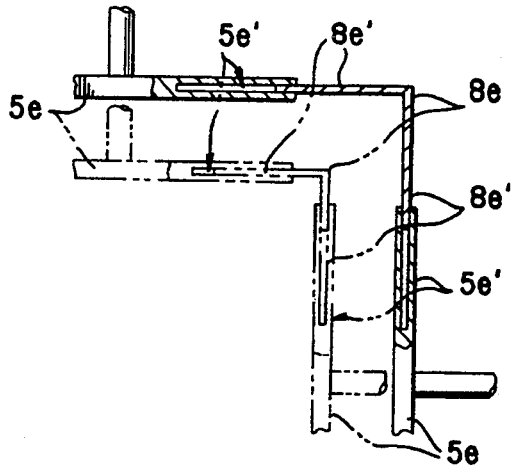

The press auxiliary jigs 8, 8*a*, 8*b*, 8*c* have been arranged to be slidably mounted in contact with the compression surfaces (the inner surfaces to abut against the wood) of the press molds 5 and press plates 5*a*, 5*b*, 5*c*. However, as shown in FIG. 6, press auxiliary jigs 8*d* may be slidably disposed in contact with the non-compression surfaces of the press plates 5*d* (the outer surfaces not to abut against the wood W). Further, as shown in FIG. 7, a press auxiliary jig 8*e* may be slidably disposed between the press plates 5*a* with its sides 8*e*′ slidably received in slits 5*e*′ formed in the adjacent press plates 5*e*.

Figure 8:
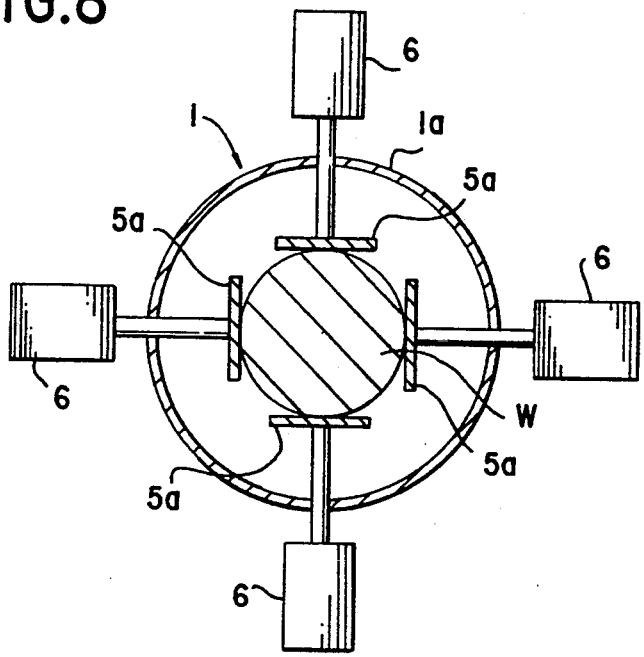
FIG. 8 is a sectional view showing a modification of a press machine not using any press auxiliary jig.

In the above description, press auxiliary jigs have been used to compression-mold the wood W; however, as shown in FIG. 8, the compression-molding of the wood w can be effected with press plates 5 alone.

Further, in the above description, a round wood material has been compression-molded into a square pillar form; however, various forms can be compression-molded depending upon the uses by changing the press molds 5 of the press machine 2.

Figure 9:
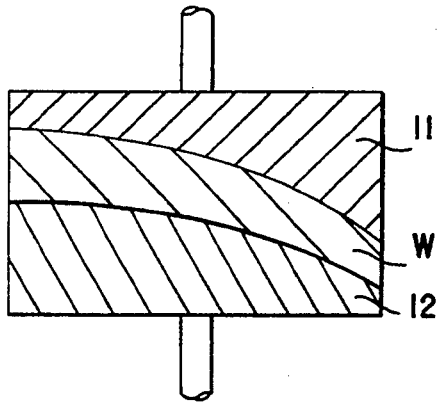
FIGS. 9–12, 13*a* and 13*b* are sectional views showing examples of formation of wood according to uses.

For example, in the case of molding a curved article, such as a leg of a household Buddist alter, as shown in FIG. 9, wood W softened in a high temperature high pressure water vapor atmosphere is compression-molded and fixed by upper and lower press molds 11 and 12 having their opposed surfaces curved.

Figure 10:
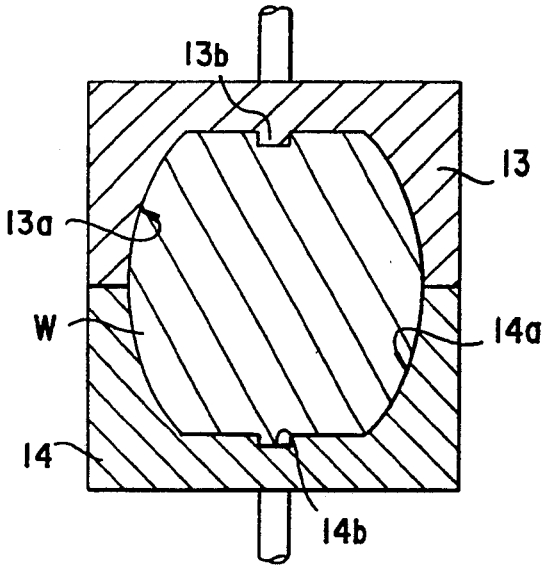
Figure 11:
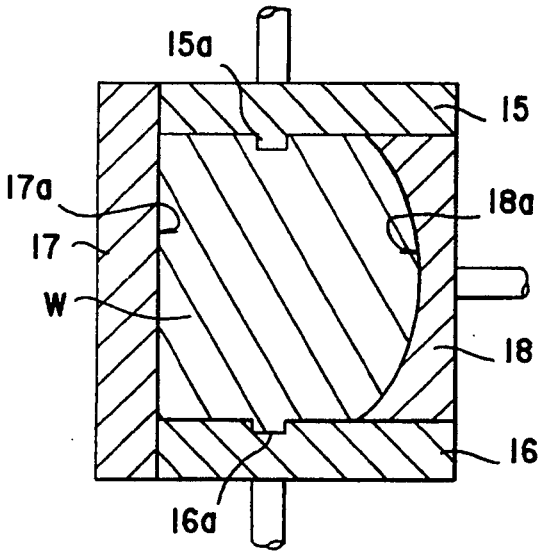

When a material for a log house is to be molded, as shown in FIG. 10, the wood W softened in a high temperature high pressure water vapor atmosphere is compression-molded and fixed by an upper press mold 13 having a dovetail ridge 13*b* on the ceiling of a cavity 13*a* whose opposed lateral sides are curved and a lower press mold 14 having a dovetail groove 14*b* in the bottom of a cavity 14*a* whose opposed lateral sides are curved. Particularly, in the case of forming a material for a log house whose surfaces opposed to the interior of the room are straight, as shown in FIG. 11, the wood W softened in a high temperature high pressure water vapor atmosphere is compression-molded and fixed by an upper press mold 15 having a dovetail ridge 15*a* on the upper surface, a lower press mold 16 having a dovetail groove 16*a* in the upper surface, a fixed transverse press mold 17 disposed with its inner lateral surface 17*a* contacted by one of the respective lateral ends of the upper and lower press molds 15 and 16, and a movable transverse press mold 18 whose inner lateral surface 18*a* is curved.

Figure 12:
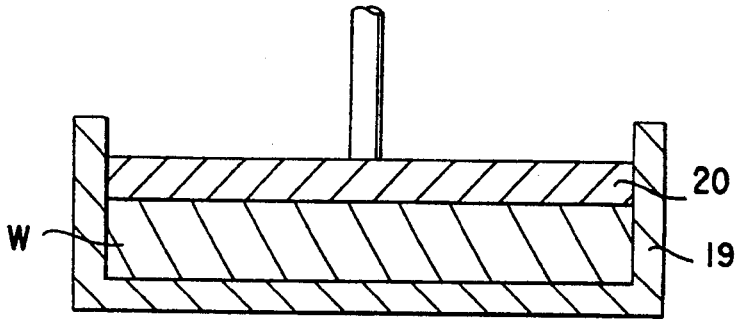

In the case of molding plate materials for floor plates, desk tops or furniture, as shown in FIG. 12, the wood W softened in a high temperature high pressure water vapor atmosphere is compression-molded and fixed by a press mold 19 having a U-shaped cross section, and a press mold 20 insertable into said press mold 19.

Figure 13A:
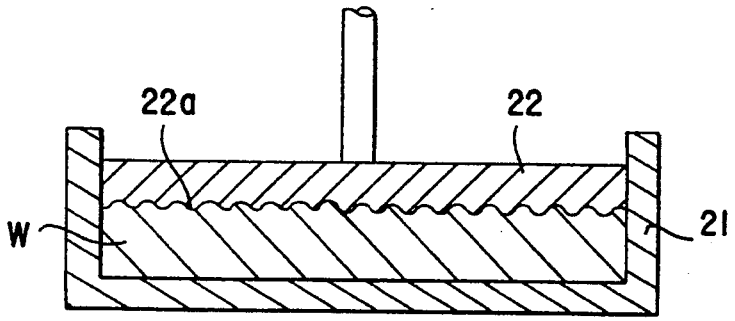
Figure 13B:
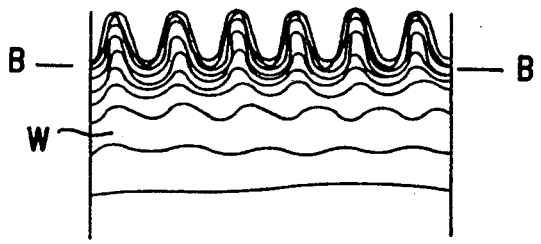

In the case of molding what is used as an alcove profile post, as shown in FIG. 13(A), the wood W softened in a high temperature high pressure water vapor atmosphere is compression-molded and fixed by a press mold 21 having a U-shaped cross section, and a press mold 22 insertable into said press mold 21 and whose compression-molding surface 22*a* is corrugated. In the case of forming a square post whose grain of wood is visible, since the growth rings in the vicinity of the surface of the wood W are compressed and made wavy by the compression-molding surface of the press mold 22, as shown in FIG. 13 (B), the wood is cut at the position indicated by the line B—B in FIG. 13 (B) (the position where the growth rings are compressed and made wavy), resulting in a desired form of growth rings appearing in the cut surface.

Even wood which is warped during drying subsequent to sawing can be easily straightened by softening it in a high temperature high pressure water vapor atmosphere, and correcting and fixing it.

Figure 14:
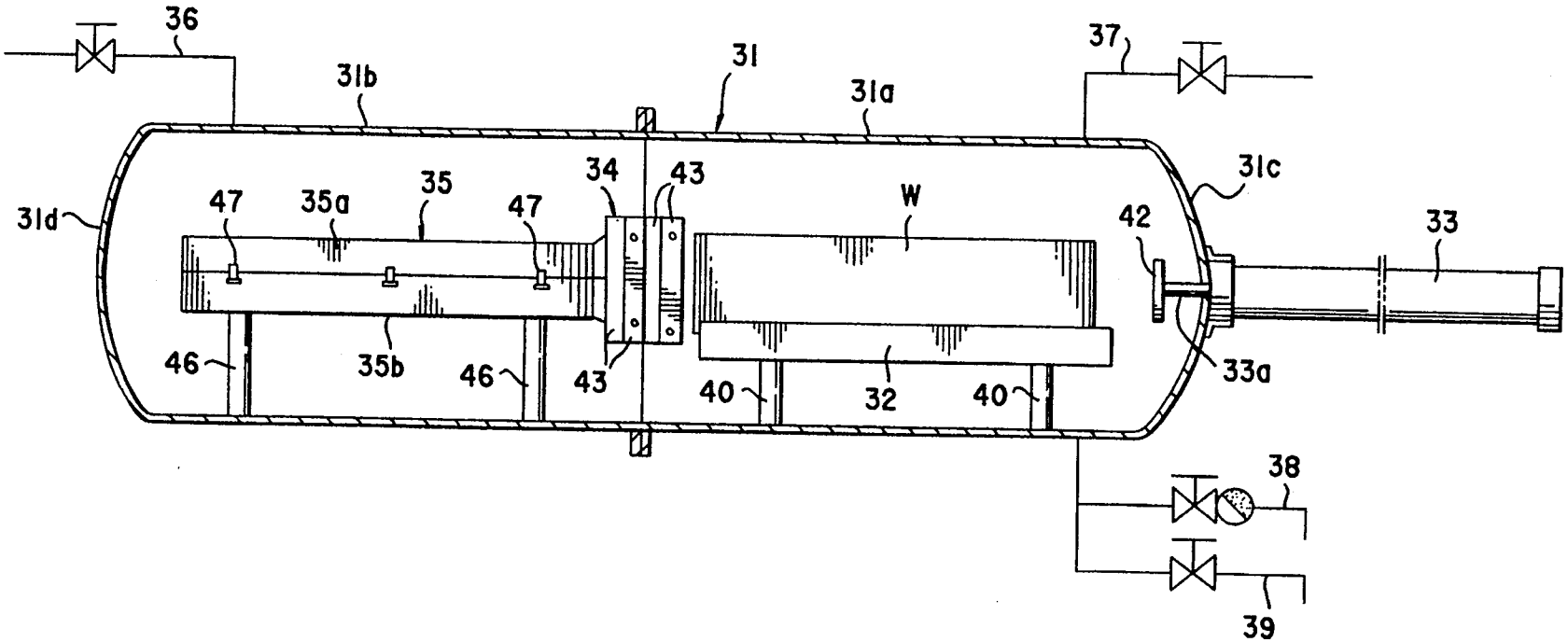
FIG. 14 is a schematic view, in longitudinal section, showing a second embodiment of the wood treating apparatus according to the invention.

FIG. 14 shows a second embodiment of the apparatus for embodying the present inventive method. The numeral 31 denotes a treating container; 32 denotes a support block; 34 denotes a roller die; 33 denotes a thrust cylinder; 34 denotes a die, e.g. a roller die; and 35 denotes a fixing case.

The treating container 31 is a sealed type high temperature high pressure container capable of receiving the support block 32, roller die 34 and fixing case 35 and comprises a bottomed cylindrical sleeves 31*a* and 31*b* separable from each other horizontally as seen in the figure, said sleeves 31*a* and 31*b* being put together by suitable fixing means; thus, the treating container is of two-piece construction. High temperature (100°–230° C.) high pressure (5–25 kgf/cm$^2$) water vapor is fed into the treating container 31 through a pipeline 37 and, according to the necessity and purpose, a gas having a chemical, such as creosote (a wood preservative), mixed therewith is also injected into the treating container through a pipeline 36. In addition, the numeral 38 denotes a pipeline for discharging the water vapor drain from the treating container 31; and 39 denotes a pipeline for opening the treating container 31 to the atmosphere for exhaust.

The support block 32 is horizontally installed at a predetermined position in the treating container 31 through pillars 40, the upper surface thereof being formed with a V-shaped groove 41 for horizontally supporting the wood W to be treated, as shown in FIG. 15.

The thrust cylinder 33 is fixed to the outer side of the lateral wall 31*c* of the treating container 31 in relation to the wood W supported on the support block 32 by suitable means and has a piston rod 33*a* extending into the treating container 31 hermetically through the lateral wall 31*c*, said piston rod 33*a* having a pusher 42 fixed to the front end thereof.

The roller die 34 is installed between the support block 32 and the fixing case 35 in the treating container 31 by suitable means and, as shown in FIGS. 16 and 17, is composed of a plurality (even number) of roller die units 43. Each roller die unit 43 comprises two rotatably supported rollers 45 of the same diameter extending parallel with a frame 44, adjacent roller die units 43 being shifted in phase by 90° relative to each other so that when combined, they form the figure of #, the successively juxtaposed roller die units 43 being integrated to form the roller die 34. In addition, in this embodiment, the roller die 43 comprises four roller die units 43, of which two form a set; thus, there is a total of two sets, the one positioned nearer to the support block 32 is referred to as the first set, the other being the second set. The distance L between the rollers 45 in each of the first and second sets of roller die units 43 is successively narrowed so that the cross sectional area ratio of the wood W is about $\frac{1}{2}$–$\frac{1}{3}$.

The fixing case 35 is installed at a predetermined position in the treating container through parallel pillars 46 and, as shown in FIG. 18, it comprises U-shaped upper and lower cases 35*a* and 35*b* separable from each other, said upper and lower cases 35*a* and 35*b* being put together to form a quadrangular prism and integrated by clasps 47; thus, it is of two-piece construction.

The treatment of the wood W by the second embodiment of the present inventive apparatus constructed in the manner described above will now be described. First, the treating container 31 is opened and the wood W to be treated is introduced thereinto and placed on the support block 32.

Then, after the treating container 31 is closed, high temperature high pressure water vapor is fed into the treating container 31 through the pipeline 37 and according to the necessity and purpose, a chemical-mixed gas having a chemical, such as creosote (a wood preservative), mixed therewith is also injected into the treating container through a pipeline 36. In this state, the wood W is left to stand for a predetermined time (several seconds to tens of minutes) for softening, whereupon the piston rod 33*a* of the thrust cylinder 33 is extended so that the wood supported on the support block 32 is pushed into the roller die 34 by the pusher 42 fixed on the front end of said piston rod 33*a*. In said roller die 34, the wood W is drawn successively by the rollers 45 of the roller die units 4e for compression-molding until it is reduced to about $\frac{1}{2}$ to $\frac{1}{3}$ in terms of the cross sectional area ratio; thereafter, it is pushed in this state into the fixing case 35.

In this state, the wood W is left to stand in the fixing case 35 for a predetermined time (several seconds to tens of minutes) for fixing, whereupon the injection and supply of the water vapor and chemical-mixed gas into the treating container 31 are stopped and at the same time the water vapor drain and the like in the treating container 31 are discharged through the pipeline 39 while the treating container 31 is gradually opened to the atmosphere through the pipeline 39. Thereafter, the treating container 31 is opened and the clasps 47 are unlocked to separate the upper case 35*a* of the fixing case 35 from the lower case 35*b*, whereupon the wood W compression-molded is removed from the lower case 35*b* of the fixing case 35 to complete the treatment.

Figure 19:
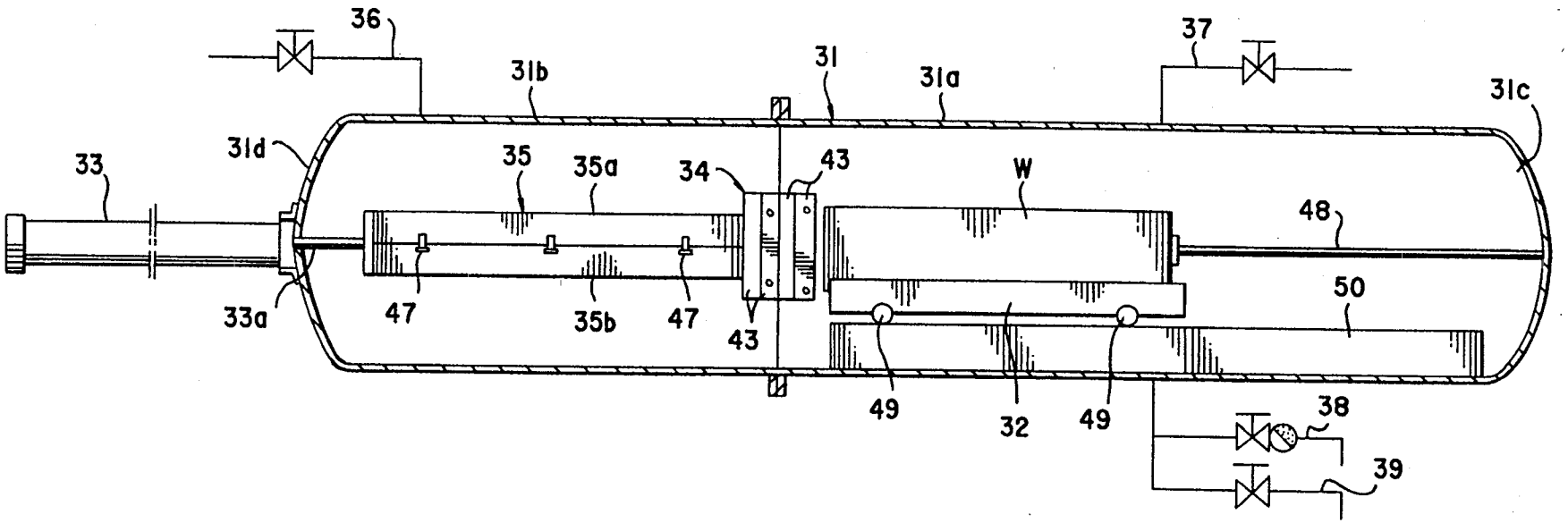
FIG. 19 is a schematic view in longitudinal section, showing a modification of the second embodiment.

In the second embodiment described above, the wood W mounted on the support block 32 is pushed into the roller die 34 and fixing case 35, thereby compression-molding the wood W; however, as shown in FIG. 19, it is also possible to compression-mold the wood W by pushing the roller die 34 and fixing case 35 over the wood W mounted on the support block 32 by a thrust cylinder 33. That is, the thrust cylinder 33 is fixed to the other lateral wall 31*d* of the treating container 31 by suitable means and has a piston rod 33*a* extending into the treating container 31, said piston rod 33*a* having a pusher 42 fixed to the front end thereof, said piston rod 33*a* having the rear end of a fixing case 35 integrally fixed to the front end thereof. A roller die 34 is integrally fixed to said fixing case 35, while a stop 48 abutting at its front end against the wood W is fixed on the inner side of the lateral wall 31*c* of the treating container 31. The support block 32 is movably mounted on a track block 50 through rollers 49. When the piston rod 33*a* of the thrust cylinder 33 is extended to push the roller die 34 and fixing case 35 over the wood W mounted on the support block 32, the wood W is compression-molded until it is reduced to about $\frac{1}{2}$ to $\frac{1}{3}$ in terms of cross sectional area ratio. Thereafter, in this state it is pushed into the fixing case 35. At this time, the position of the wood W remains fixed by the stop 48, and since the support block 32 moves to the right as seen in the figure through the rollers 49 as it is pushed by the roller die 34, it is possible to put the roller die 34 and fixing case 35 over the wood W.

In the second embodiment described above, the wood W has been formed from a circular cross section to a square one by the roller die 34; however, it is also possible to form circular, rectangular, hexagonal and other polygonal cross sections, depending upon uses. For example, as shown in FIG. 20, a corn die 51 may be installed in place of the roller die 34 of FIG. 14 between the support block 32 and the fixing case 36; thus, the wood W is pushed into the corn die 51 through its larger diameter end 51*a* and out of the same through its smaller diameter end 51*b*, whereby the wood W can be compression-molded to have a circular cross section. Further, if a corn die 52 as shown in FIG. 21 is used, it is possible to effect compression molding from a circular cross section to a square one.

What is claimed is:

1. A wood treating method comprising the steps of softening a piece of wood in a high temperature, high pressure, water vapor atmosphere having a temperature between 100° and 230° C. and a pressure between 5 and 25 kgf/cm$^2$, then compression-molding the wood under a high temperature, ordinary pressure condition so that the wood is compressed to between $\frac{1}{2}$ and $\frac{1}{3}$ of its original size and fixing the resulting deformation by holding the wood in a compressed state for a predetermined length of time.

2. The method according to claim 1, wherein the wood is compressed to between $\frac{1}{2}$ to $\frac{1}{3}$ of its original size.

3. The method according to claim 1, wherein the wood is held in a compressed state for a length of time between several tens of seconds and tens of minutes.

4. A wood treating apparatus comprising:

a treating container having means for feeding high temperature high pressure water vapor having a temperature between 100° and 230° C. and a pressure between 5 and 25 kgf/cm$^2$, a press machine having press molds inside said treating container suitably disposed in opposed relation to each other, wherein at least one of the opposed press molds is driven by suitable means to compression-mold a piece of wood so that the wood is compressed to between $\frac{1}{2}$ and $\frac{1}{3}$ of its original size.

5. The apparatus according to claim 4, wherein the press molds of said press machine are replaceable, such that various shaped press molds can be selectively employed in said press machine depending upon the intended use of the wood.

6. The aparatus according to claim 4, further comprising means for feeing a chemical-mixed gas into said treating container.

* * * * *

UNITED STATES PATENT AND TRADEMARK OFFICE

CERTIFICATE OF CORRECTION

PATENT NO. : 5,343,913

DATED : September 6, 1994

INVENTOR(S) : Mitsuhiko TANAHASHI et al

It is certified that error appears in the above-indentified patent and that said Letters Patent is hereby corrected as shown below:

On the title page, Item [63], after "Pat. No. 5,247,975", insert -- filed as PCT/JP/90/01681 on December 21, 1990,

Signed and Sealed this

Twenty-fifth Day of April, 1995

*Attest:*

Bruce Lehman

BRUCE LEHMAN

*Attesting Officer*

*Commissioner of Patents and Trademarks*